US006538542B2

(12) United States Patent
Nishikawa

(10) Patent No.: US 6,538,542 B2
(45) Date of Patent: Mar. 25, 2003

(54) MAGNETIC SENSOR SWITCH

(75) Inventor: Kikuyoshi Nishikawa, Yokohama (JP)

(73) Assignee: Sagami Electric Co., Ltd., Kanagawa (JP)

( * ) Notice: Subject to any disclaimer, the term of this patent is extended or adjusted under 35 U.S.C. 154(b) by 0 days.

(21) Appl. No.: 10/057,291

(22) Filed: Jan. 25, 2002

(65) Prior Publication Data

US 2002/0149454 A1 Oct. 17, 2002

(30) Foreign Application Priority Data

Jan. 25, 2001 (JP) ..... 2001-016988

(51) Int. Cl.[7] ..... H01H 9/00
(52) U.S. Cl. ..... 335/205; 335/207; 324/207.25
(58) Field of Search ..... 335/205–208; 324/207.11, 207.13, 207.22–207.26

(56) References Cited

U.S. PATENT DOCUMENTS 3,325,756 A * 6/1967 Maxwell ..... 200/404
4,837,539 A * 6/1989 Baker ..... 324/207.26

* cited by examiner

*Primary Examiner*—Ramon M. Barrera
(74) *Attorney, Agent, or Firm*—David N. Lathrop, Esq.; Gallagher & Lathrop

(57) ABSTRACT

A magnetic sensor switch is provided in which a magnetic sensor is responsive only when a magnet approaches it, to turn electrical contacts of the switch on and off. A cylindrical magnetic sensor having oppositely polarized magnetic poles at opposite ends thereof is mounted for rotation in clockwise and counter-clockwise directions. An auxiliary magnet is located in a region outside of the rotating radius of the magnetic sensor and in the vicinity of one magnetic pole of the magnetic sensor. The auxiliary magnet imparts a biasing force for holding the magnetic sensor at a position rotated through a predetermined angle. A movable contact piece is attached to the magnetic sensor and is adapted to be rotated as the magnetic sensor is rotated to thereby bring corresponding contact or contacts of the movable contact piece into contact with one of a pair of fixed contact pieces located in opposition to the contacts of the movable contact piece.

20 Claims, 10 Drawing Sheets

MAGNETIC SENSOR SWITCH

BACKGROUND OF THE INVENTION

1. Field of the Invention

The present invention relates to a magnetic sensor switch that is operable in response to external magnetism to turn its contacts on and off, and more particularly, to an elongated and miniaturized magnetic sensor switch of the type that comprises a magnetic sensor responsive to approach of a magnet, electrical contacts, and a movable contact piece adapted to be operable in accordance with the movement of the magnetic sensor to turn the electrical contacts on and off.

2. Description of the Related Art

As is disclosed in Japanese Patent Application Public Disclosure No. hei 6-347559 (347559/1994), for example, a magnetic sensor consisting of a combination of a permanent magnet and a reed switch responsive to magnetism has been heretofore known. As shown in FIG. 1, the magnetic sensor disclosed in the Japanese Patent Application Public Disclosure No. 347559/1994 comprises an elongated cylindrical case 71 made of a non-magnetic material, a reed switch 75 disposed in the interior of the case 71 generally in the center thereof, a columnar permanent magnet 73 mounted in the interior of the case 71 at the forward end (left-hand end as viewed in the drawing), a magnetic plate 87 attached to the outer side wall of the enclosure (glass tube in this example) 77 of the reed switch 75, and a magnetism adjusting permanent magnet 74 mounted at the peripheral area of the glass tube 77 adjacent one end thereof. The two permanent magnets 73 and 74 positioned on the opposite sides of the reed switch 75 are configured such that the opposing sides of the magnets 73 and 74 have the same magnetic polarity. In this example, the magnetic polarities of the opposing sides (the reed switch side) of the two magnets 73 and 74 are set both to be the S magnetic pole.

The reed switch 75 is positioned generally in the center of the case 71 by two spaced rings 76 and 78 both of which are made of heat-resistant, electrical insulating material. The root portion of the case 71 is mounted to a sensor mounting base 95 by means of a bushing 91 made of rubber. Lead wires 96 and 99 leading out from reeds 93 and 94, both being made of a magnetic material, of the reed switch 75 are connected to suitable heat-resistant, insulated wires 89 and 90, respectively, that extend to the outside through the root portion of the case 71. As is well known, the forward ends of these reeds 93 and 94 comprise contact portions 79 acting as electrical contacts.

Next, the operation of the magnetic sensor constructed as described above will be briefly explained with reference to FIGS. 2 and 3. FIG. 2 shows magnetic lines of force generated from the magnetic sensor shown in FIG. 1 when the magnetic sensor is in the standby state in which there is no magnetic substance (object) or magnet in the vicinity around the sensor. From FIG. 2, it will be appreciated that there is a very weak magnetic field produced in the vicinity of the contact portions 79 of the reed switch 75. The distribution of the magnetic lines of force generated from the magnetic sensor during this standby state may be preliminarily adjusted by moving the magnetism adjusting permanent magnet 74 longitudinally of the case 71. When the magnetic field applied in the vicinity of the contact portions 79 of the reed switch 75 is relatively weak as shown in FIG. 2, the contact portions 79 remain open, and hence the reed switch 75 is in the off state.

As a magnetic substance or magnet approaches the vicinity of the magnetic sensor in the standby state, the magnetic field applied to the reed switch 75 changes. FIG. 3 shows magnetic lines of force generated from the magnetic sensor when two iron balls 97 and 98 being magnetic material approach the vicinity of the forward end of the reed switch 75. As is apparent from FIG. 3, the magnetic field in the vicinity of the contact portions 79 of the reed switch 75 is significantly intensified as compared with that in the standby state. As a result, the reeds 93 and 94 made of a magnetic material magnetically attract and contact each other, and hence the contact portions 79 go to on state. Further, the detailed construction, structure and operation of this magnetic sensor are disclosed in Japanese Patent Application Public Disclosure No. 347559/1994. Accordingly, further description thereof is omitted for purposes of convenience.

This magnetic sensor includes the magnetic plate 87 disposed in the vicinity of the contact portions 79 and the magnetism adjusting permanent magnet 74 positioned at the one end of the reed switch 75 near the base of the case, in addition to the permanent magnet 73, so that the magnetic field produced by the permanent magnet 73 in the vicinity of the contact portions 79 of the reed switch 75 may be adjusted by the magnetic plate 87 and the magnetism adjusting permanent magnet 74 to control the dynamic or operating sensitivity of the contact portions 79 of the reed switch 75.

As discussed above, this magnetic sensor is configured such that the magnetic field produced mainly by the permanent magnet 73 is applied directly to the reed switch 75 and the contact portions 79 of the reed switch 75 is controlled to turn on and off by that the applied magnetic field is varied by a magnetic substance or a magnet approaching the magnetic sensor. Otherwise stated, this is a magnetic switch of the type in which the magnetic field applied directly to the reed switch 75 is varied by an approaching magnetic substance or magnet whereby the opposing reeds 93 and 94 of the reed switch 75 are attracted to each other so that the contact portions 79 are controlled to the on position.

It is thus to be understood that the switch of this magnetic sensor would not be turned on unless there occurs a change in the magnetic field to some extent. Further, this magnetic sensor will be turned on, irrespective of the polarity of a magnet approaching the magnetic sensor and even if the approaching object is a magnetic substance or object rather than a magnet. For this reason, the illustrated prior art magnetic sensor can not be used in applications where the switch of the magnetic sensor is required to be turned on and off only when it is approached by a particular magnetic pole of a magnet.

In addition, because the prior art magnetic sensor as described above utilizes a reed switch, it has the disadvantages that the cost of manufacture is correspondingly increased and moreover, in the event of failure of the contact portions, the entire reed switch must be replaced, which leads to an increase in the maintenance cost.

SUMMARY OF THE INVENTION

An object of the present invention is to provide an elongated and miniaturized magnetic sensor switch that does not utilize a switch such as a reed switch in which a magnetic field is applied directly to the contact portions thereof.

Another object of the present invention is to provide an elongated and miniaturized magnetic sensor switch in which a magnetic sensor thereof is responsive only when a particular magnetic pole of a magnet approaches it, to turn electrical contacts of the switch on and off through a movable contact piece thereof.

In order to accomplish the foregoing objects, in one aspect of the present invention, there is provided a magnetic sensor switch that comprises: an elongated magnetic sensor that has N magnetic pole at one end thereof and S magnetic pole at the other end thereof and that is mounted for rotation through a predetermined angle in the clockwise and counter-clockwise directions; a movable contact piece provided with a pair of contacts; a pair of fixed contact pieces located in opposition to the pair of contacts of the movable contact piece; a common contact piece electrically connected with the movable contact piece; and a member that is located at a predetermined position in a region outside of the rotating radius of the magnetic sensor and in the vicinity of the one magnetic pole of the magnetic sensor and that imparts a biasing force for holding the magnetic sensor at a position rotated through a predetermined angle.

The biasing force imparting member is an auxiliary magnet or a magnetic material that is disposed in a region outside of the rotating radius of the magnetic sensor and at a predetermined position on a longitudinal extension line of the magnetic sensor.

In one preferred embodiment, the magnetic sensor is an elongated generally cylindrical rod-like magnet having N magnetic pole at one end thereof and S magnetic pole at the other end thereof.

Alternatively, the magnetic sensor may be an elongated generally cylindrical member that comprises; a cylindrical central body made of a magnetic material; a first cylindrical magnet affixed to the cylindrical central body at one end thereof; and a second cylindrical magnet affixed to the cylindrical central body at the other end thereof.

The aforesaid magnetic sensor switch further includes a shaft securing member of a generally channel-shape in section that is fixed to the contact portion of the common contact piece, and the magnetic sensor is rotatably journalled by this shaft securing member.

The movable contact piece is attached to the magnetic sensor and to be rotated in union with the magnetic sensor when the magnetic sensor is rotated to bring one of the contacts of the movable contact piece into contact with the corresponding fixed contact piece.

The biasing force imparting member is an auxiliary magnet that is disposed in a region outside of the rotating radius of the magnetic sensor and at a predetermined position on a longitudinal extension line of the magnetic sensor, and the magnetic sensor is adapted to be held at a position rotated through a predetermined angle by an attractive force between the auxiliary magnet and the corresponding magnetic pole of the magnetic sensor, or by a repulsive force between the auxiliary magnet and the corresponding magnetic pole of the magnetic sensor.

The aforesaid magnetic sensor switch further includes a driving member that transmits the movement of the magnetic sensor to the movable contact piece, and this driving member is attached to the magnetic sensor and adapted to be rotated in union with the magnetic sensor when the magnetic sensor is rotated to transmit the movement of the magnetic sensor to the movable contact piece.

The pair of fixed contact pieces and the common contact piece are each strip-like members that extend in parallel from one end of an elongated generally rectangular substrate to the vicinity of the central portion between the longitudinal opposite ends thereof and that are mounted on the substrate, and the contact portion of the common contact piece is arranged generally in a row longitudinally of the substrate in a space between the contact portions of the pair of fixed contact pieces in such state that they are electrically insulated from one another.

In another preferred embodiment, the driving member is formed therethrough with a push-rod inserting hole in which a spring for imparting a biasing force and a push-rod are inserted in the order named, and the tip end the push-rod is in engagement with the movable contact piece.

It is preferable that the movable contact piece is constituted by a generally rectangular electrically conductive member, and a movable contact piece body of the conductive member is bent downwardly on the opposite sides of the longitudinal central portion of the conductive member to give slants extending downwardly toward the opposite longitudinal ends.

With the construction of the present invention described above, since a clicking action is added due to the provision of the auxiliary magnet or magnetic material, or a biased push-rod, the rotating movement of the magnetic sensor switch may be instantaneously effected and the switching-over of the switch may be instantaneously carried out. Consequently, the reliability of the switch may be enhanced. In addition, it is possible to reduce the cost of a product as well as the maintenance cost, because it does not utilize a switch in which a magnetic field is applied directly to the contact portions thereof such as a reed switch.

BRIEF DESCRIPTION OF THE DRAWINGS

FIGS. 2 and 3 are diagrammatical views for explaining the operation of the prior art magnetic sensor shown in FIG. 1, wherein FIG. 2 shows magnetic lines of force generated from the magnetic sensor when the magnetic sensor is in the standby state, and FIG. 3 shows magnetic lines of force generated from the magnetic sensor when the magnetic sensor has sensed a magnetic substance;

FIG. 10 shows the elongated generally cylindrical case used in the first embodiment, wherein

FIG. 11 shows the generally cylindrical cap used in the first embodiment, wherein

FIG. 13 illustrates the steps of assembling the shaft securing member to the common contact piece both used in the first embodiment, wherein

FIG. 14 shows the movable contact piece used in the first embodiment, wherein

FIG. 17 illustrates the steps of assembling the magnetic sensor and the driving member both used in the second embodiment, wherein

FIG. 18 shows the shaft securing member used in the second embodiment, herein FIG. 19 shows the movable contact piece used in the second embodiment, wherein

DETAILED DESCRIPTION OF THE PREFERRED EMBODIMENTS

The preferred embodiments of the present invention will now be described in detail with reference to FIGS. 4 to 19. The present invention may, however, be embodied in many different forms and should not be construed as limited to the embodiments set forth hereinafter; rather, the embodiments are provided so that this disclosure will be thorough and complete, and will fully convey the scope of the invention to those skilled in the art.

Figure 1:
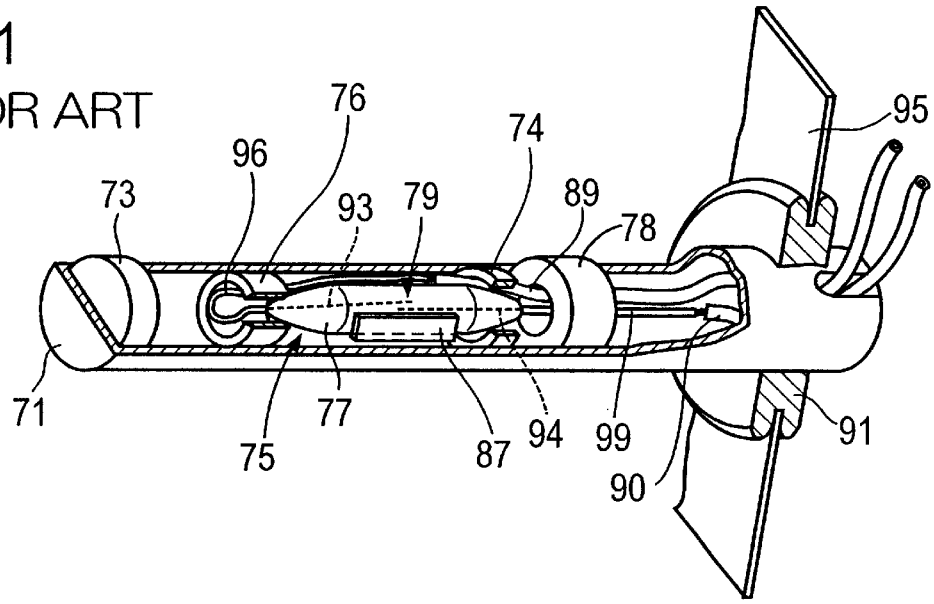
FIG.1 PRIOR ART
FIG. 1 is a perspective view, partly cut away, illustrating an example of the prior art magnetic sensor.
Figure 2:
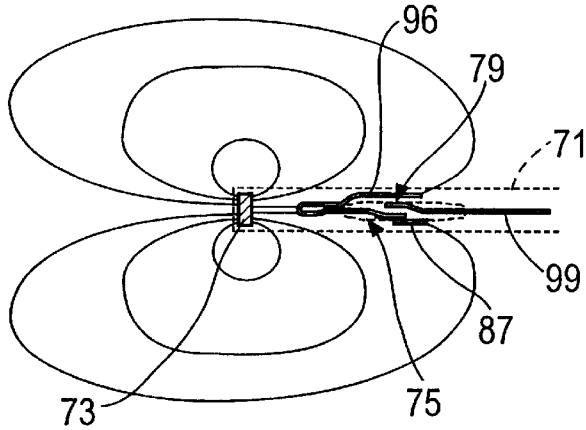
FIG.2 PRIOR ART
Figure 3:
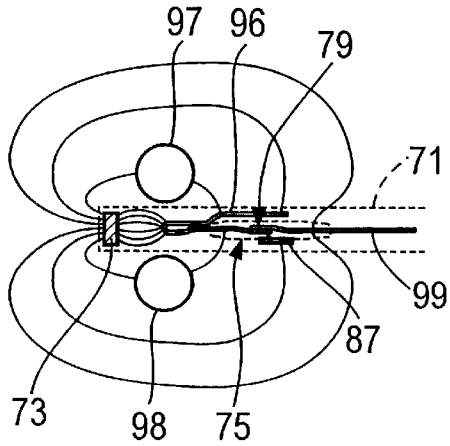
FIG.3 PRIOR ART
Figure 4:
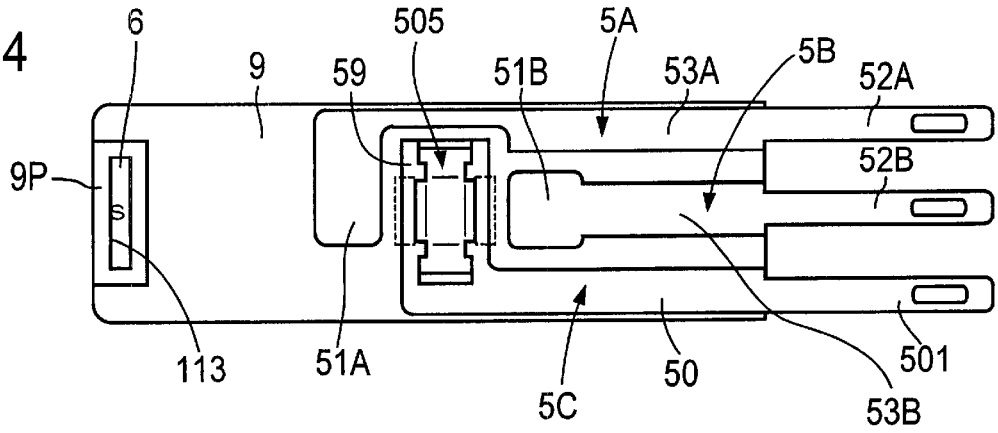
FIG. 4 is a plan view showing the substrate used in a first embodiment of the present invention, and the first and second fixed contact pieces, the common contact piece, the shaft securing member and the auxiliary magnet mounted on the substrate.
Figure 5:
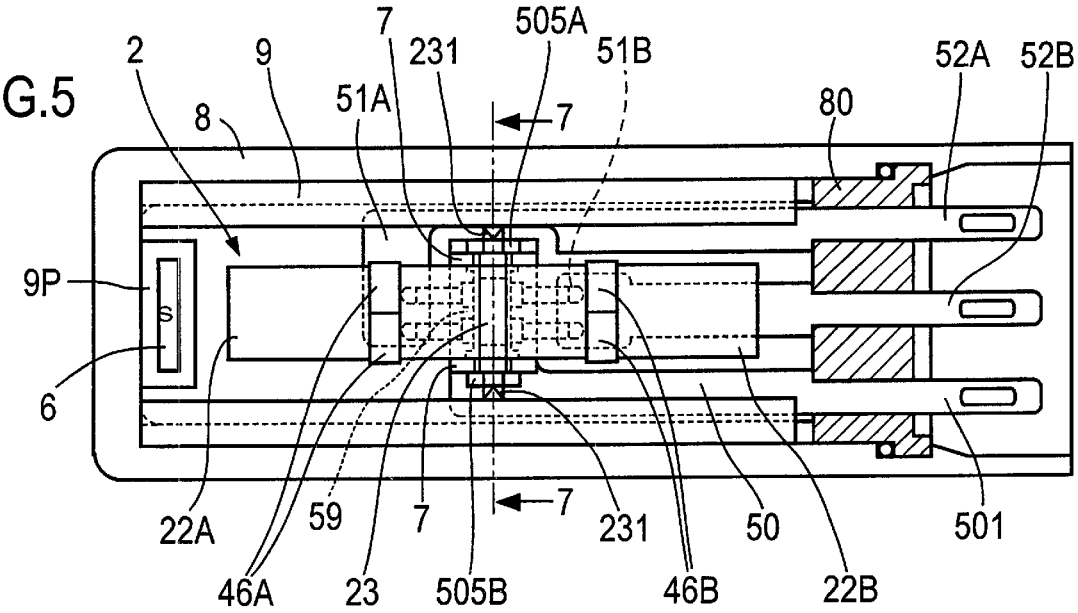
FIG. 5 is a plan view showing the first embodiment of the magnetic sensor switch according to the present invention.
Figure 6:
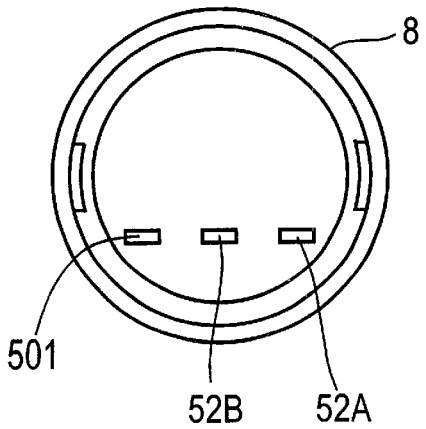
FIG. 6 is a right-hand side view of FIG. 5.
Figure 7:
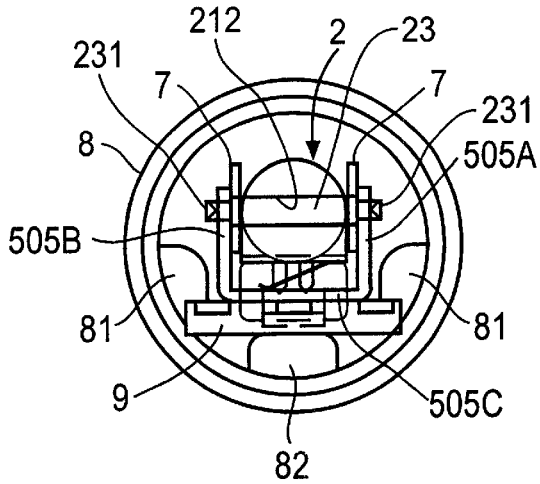
FIG. 7 is a sectional view taken along the line 7—7 in FIG. 5 and looking in the direction indicated by the arrows.
Figure 8:
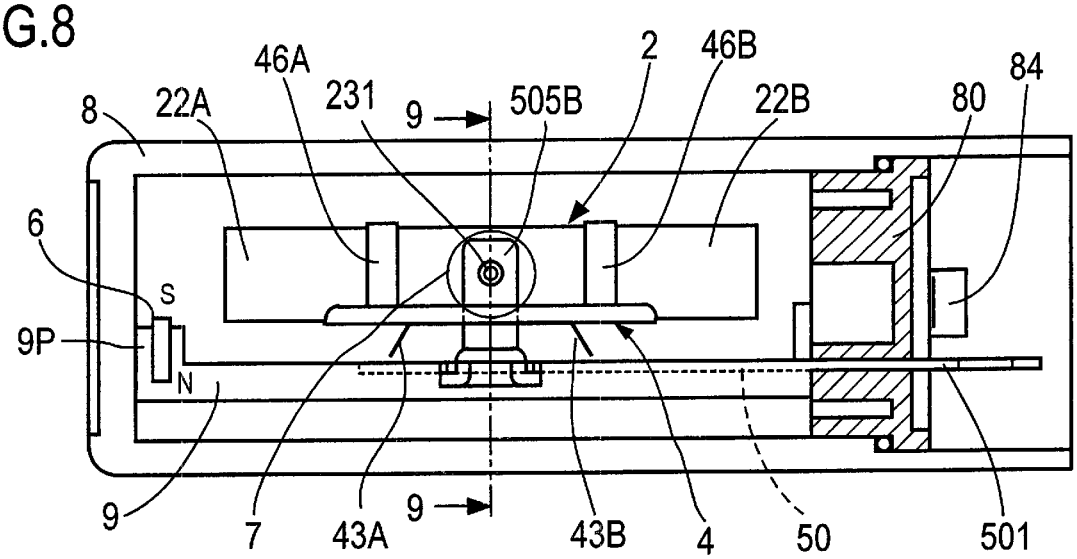
FIG. 8 is a side view of FIG. 5 as viewed from below.
Figure 9:
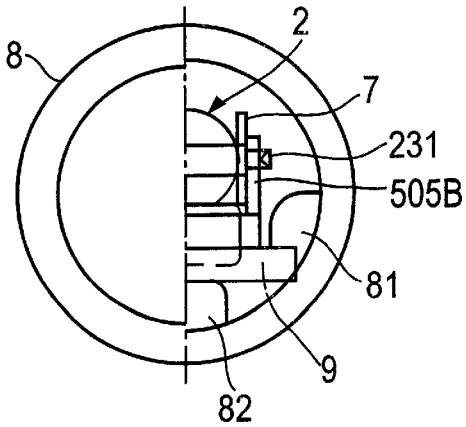
FIG. 9 is a sectional view taken along the line 9—9 in FIG. 8 and looking in the direction indicated by the arrows.

A first embodiment of the magnetic sensor switch according to the present invention will be described with reference to FIGS. 4–14. FIG. 4 is a plan view showing the substrate 9 used in the first embodiment and some of the component elements (members) mounted on the substrate 9, and FIG. 5 is a plan view showing a manner that the substrate 9 shown in FIG. 4 having mounted thereon all of the component elements is housed in an elongated generally cylindrical case 8, with the upper half of the case 8 being removed to illustrate the interior of the case but with only the cap 80 for closing the open end of the case 8 being shown in a cross-sectional view. FIG. 6 is a right-hand side view of FIG. 5, FIG. 7 is a sectional view taken along the line 7—7 in FIG. 5 and looking in the direction indicated by the arrows, FIG. 8 is a side view of FIG. 5 as viewed from below, with the front side half of the case 8 being removed to illustrate the interior of the case 8, the cap 80 being shown in a cross-sectional view, and the auxiliary magnet 6 being shown like a cross-sectional view. FIG. 9 is a sectional view taken along the line 9—9 in FIG. 8 and looking in the direction indicated by the arrows, but only showing the right-hand side half only as it is symmetrical with respect to the vertical axis.

Figure 13A:
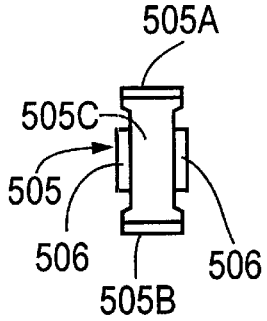
FIG. 13A is a plan view of the shaft securing member.
Figure 13B:
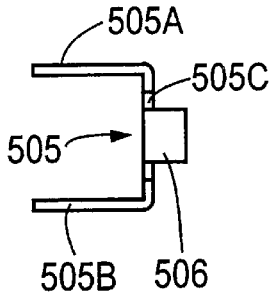
FIG. 13B is a side view of FIG. 13A viewed from the right-hand side thereof.
Figure 13C:
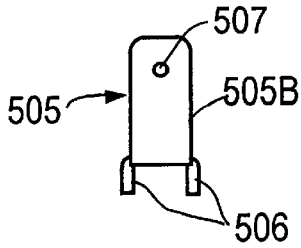
FIG. 13C is a side view of FIG. 11A as viewed from below.
Figure 13D:
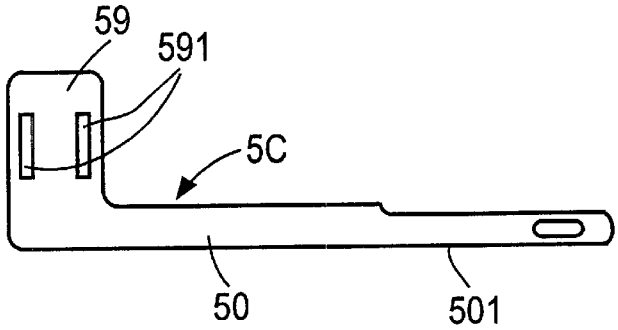
FIG. 13D is a plan view of the common contact piece.

As shown in FIGS. 4 through 9, a pair of first and second strip-like fixed contact pieces 5A, 5B and a common contact piece 5C likewise in the form of a strip are mounted on a generally rectangular substrate 9 such that they extend substantially in parallel with one another from one end (right-hand end in FIG. 4) to near the middle of the substrate 9 in the longitudinal direction thereof. The common contact piece 5C extends along one longitudinal side edge of the substrate 9, with its common contact portion 59 being folded substantially at a right angle from the central body 50 and the terminal portion 501 of the common contact piece 5C as shown in FIG. 13D as well as extending transversely (in the direction of the minor side) of the substrate 9 in the middle thereof. The first fixed contact piece 5A extends along the other longitudinal side edge of the substrate 9, with its contact portion 51A being folded substantially at a right angle from the central body 53A and the terminal portion 52A of the fixed contact piece 5A as well as extending parallel to the common contact portion 59 of the common contact piece 5C transversely of the substrate 9 in the middle thereof but closer to the other end of the substrate 9 than the common contact portion 59. The second fixed contact piece 5B has the terminal portion 52B, the contact portion 53B and the contact portion 51B aligned in a substantially straight line, with the contact portion 51B disposed in the vicinity of the middle of the substrate 9 close to the common contact portion 59 of the common contact piece 5C. It will thus be appreciated that the contact portion 59 of the common contact piece 5C is disposed in a space between the contact portion 51A of the first fixed contact piece 5A and the contact portion 51B of the second fixed contact piece 5B in a manner that it is electrically insulated from both the contact portions 51A and 51B. It is to be noted that these contact pieces 5A, 5B, and 5C may be produced by working and processing a sheet metal, for example.

The terminal portions 52A and 52B of the pair of first and second fixed contact pieces 5A and 5B, respectively, and the terminal portion 501 of the common contact piece 5C project out of the substrate 9 beyond the one end thereof. As can easily be appreciated from FIG. 7, in this embodiment, the contact portions 51A and 51B and the bodies 53A and 53B of the first and second fixed contact pieces 5A and 5B, respectively, and the contact portion 59 and the body 50 of the common contact piece 5C are fitted in corresponding grooves formed in the substrate 9 and have only their upper surfaces exposed. Of course, such arrangement and construction are merely one example.

Figure 12:
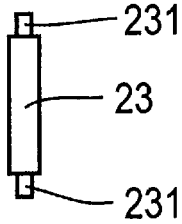
FIG. 12 is a plan view showing the rotary shaft used in the first embodiment.

Mounted on the contact portion 59 of the common contact piece 5C is a shaft securing member 505 for fixing a rotary shaft 23 (see FIGS. 5, 7 and 12) that is in turn adapted for rotatably mounting the magnetic sensor 2 constituted by an elongated generally cylindrical rod-like magnet. As can be appreciated from FIG. 7, the shaft securing member 505 has a generally channel-shape (U-shape) in cross-section. As shown in FIG. 12, the rotary shaft 23 has portions 231 to be riveted on its opposed ends for fixing the rotary shaft 23 to the shaft securing member 505 by riveting the portions 231 of the rotary shaft 23 on the shaft securing member 505.

In this embodiment, the magnetic sensor 2 has its one end portion 22A polarized as N magnetic pole and the other end portion polarized as S pole and is mounted on the rotary shaft 23 fixed to the shaft securing member 505 for rotation in the clockwise and counter-clockwise directions about the rotary shaft 23. The magnetic sensor 2 has a bearing aperture 212 into which the rotary shaft 23 is to be inserted, the bearing aperture 212 being formed through the magnetic sensor 2 in the center thereof perpendicularly to its longitudinal axis. The magnetic sensor 2 further has its central lower peripheral portion opposing the substrate 9 longitudinally removed to define a generally rectangular recessed flat region. The flat region extends on the both sides of the longitudinal center of the magnetic sensor 2 from the center to substantially equal predetermined lengths, and a movable contact piece 4 is mounted to the flat region. As will be described later, the movable contact piece 4 has attaching strips or bands 46A, 46B formed integrally therewith at a predetermined spacing along the opposed longitudinal side edges of the movable contact piece 4, and is mounted to the flat region of the magnetic sensor 2 by wrapping, tightening, and fixing the attaching strips 46A and 46B around the outer periphery of the magnetic sensor 2.

A rectangular plate-like auxiliary magnet 6 is mounted to the substrate 9 near the other end thereof. It is preferable that the auxiliary magnet 6 is located on a longitudinal extension line of the cylindrical magnetic sensor 2 as well as in the vicinity of the magnetic pole 22A at one end (left end in this example as viewed in FIG. 8) of the magnetic sensor 2 and below the center of the magnetic pole 22A when the magnetic sensor 2 is at rest in its standby state position (in this example, when the magnetic sensor 2 is at rest in the tilted state that its left end magnetic pole 22A is lowered as viewed in FIG. 8).

In this embodiment, the substrate 9 has an elongated raised portion 9P formed integrally therewith in the center of the other end portion thereof and extending in the direction of the width of the substrate 9, and a groove 113 of rectangular shape in cross-section is formed in the raised portion 9P in such manner that it extends in the direction of the width of the substrate 9. The elongated groove 113 is located such that it will lie generally on a longitudinal extension line of the magnetic sensor 2 when the magnetic sensor 2 is rotated through certain degrees in the counterclockwise direction from the horizontal position shown in FIG. 8 (although the magnetic sensor 2 is not adapted to rotate up to such position). Accordingly, the auxiliary magnet 6 is shaped in the form of a rectangular plate so as to mate with the groove 113. As can be appreciated from FIG. 8, the groove 113 is cut from the surface of the raised portion 9P into the body of the substrate 9 and the auxiliary magnet 6 is fitted in the groove 113 with the upper portion thereof projecting beyond the groove 113. In this embodiment, the auxiliary magnet 6 is polarized such that the end portion thereof exposed from the groove 113 is made S magnetic pole while the opposite end portion (the end portion toward the bottom of the groove 113) is made N magnetic pole whereby the S magnetic pole of the auxiliary magnet 6 and the magnetic pole (N pole) at the corresponding end of the magnetic sensor 2 are attracted toward each other. It is to be understood, however, that the auxiliary magnet 6 may be fitted in the groove 113 with its S magnetic pole and N magnetic pole reversed. In that case, the magnetic poles of the magnetic sensor 2 should likewise be reversed. Or alternatively, the magnetic sensor may be held at a standby position that is a position rotated through predetermined degrees from the horizontal position by the utilization of the repulsive force of the auxiliary magnet 6.

Further, it should be understood that the elongate groove 113 may be formed to extend in the longitudinal direction of the substrate 9 and that the auxiliary magnet 6 may be fitted in that groove. In other words, the auxiliary magnet 6 may be mounted such that its planar plane extends in parallel with the length of the substrate 9. In addition, the auxiliary magnet 6 may be secured directly to the substrate 9 rather than being fitted in the elongate groove 113.

Figure 10A:
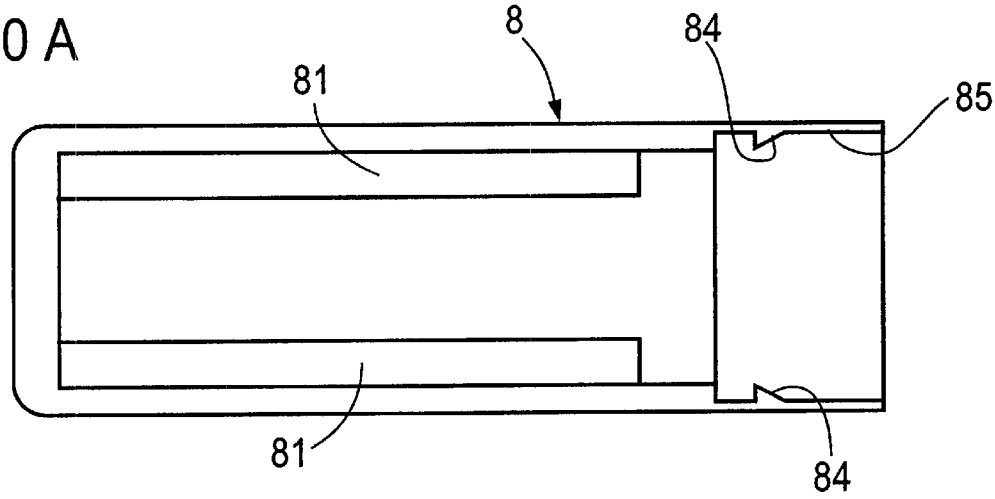
FIG. 10A is a plan view of the case.
Figure 10B:
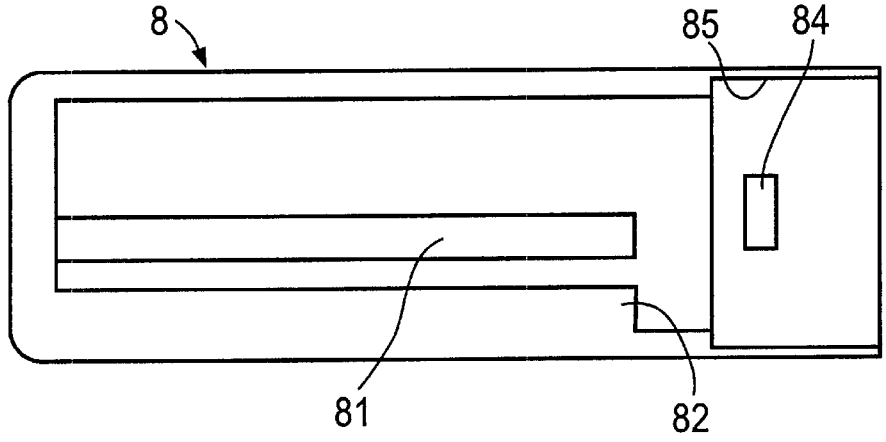
FIG. 10B is a side view of FIG. 10A as viewed from below.
Figure 10C:
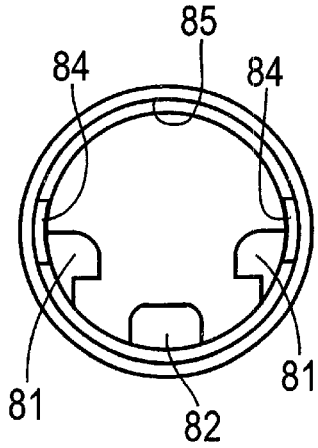
FIG. 10C is a right-hand side view of FIG. 10A.

Next, the elongated generally cylindrical case 8 for accommodating the substrate 9 will be described in details with reference to FIG. 10. The elongated generally cylindrical case 8 is made from a synthetic resin and is closed at one end (left end in FIG. 10) and open at the other end. The case 8 has a pair of opposed positioning ribs 81 formed on its inner peripheral surface along the length of the substrate 9 at positions below the horizontal central line and symmetrical about the vertical central line of the case 8. The positioning ribs 81 are formed in their underside with substantially right-angled steps that serve to position the upper surface and the opposite side edges of the substrate 9 inserted into the case 8. The case 8 further has a supporting rib 82 for supporting the under surface of the substrate 9 formed on its inner peripheral surface along the length of the substrate 9 at a position below the pair of positioning ribs 81, in this example, at the central position on the bottom of the inner peripheral surface of the case 8. The supporting rib 82 has a horizontal flat top surface and the height of the supporting rib 82 is set such that there is left a gap corresponding to the thickness of the substrate 9 between the top surface of the supporting rib 82 and the plane extending between the horizontal surfaces of the steps of the pair of positioning ribs 81.

The open end portion of the case 8 is reduced in wall thickness to define a cap fitting portion 85 in which a cylindrical cap 80 is adapted to be fitted. The cap fitting portion 85 has engagement protuberances 84, two in this example, formed integrally therewith at diametrically opposed positions that serve to prevent withdrawal of the cap 80 fitted in the cap fitting portion 85.

Figure 11A:
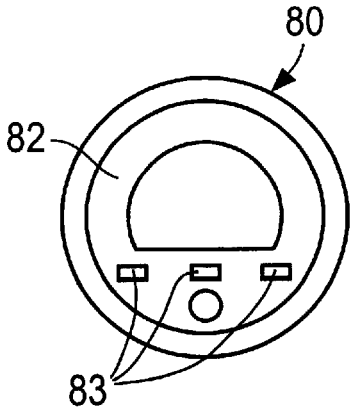
FIG. 11A is a front view of the cap.
Figure 11B:
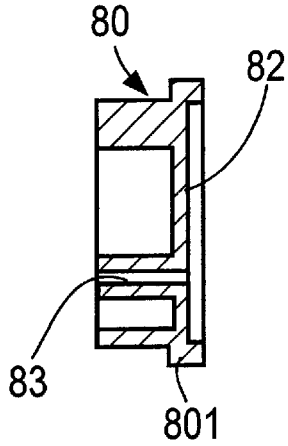
FIG. 11B is a sectional view taken along the vertical center line of FIG. 11A and viewed from the right-hand side thereof.
Figure 11C:
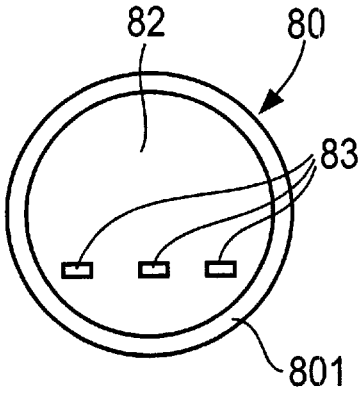
FIG. 11C is a rear view of FIG. 11A.

As shown in FIG. 11, the cylindrical cap 80 has a circular flange 801 formed integrally therewith around the outer periphery of the closed end thereof. The flange 801 is adapted to mate with and slide along the cap fitting portion 85 until it comes into abutment with and stopped by the thick-walled portion of the peripheral wall of the case 8, as the cap 80 is fitted into the case 8. At this point of time, the outer periphery of the cap 80 except the flange 801 is in fitted engagement with the inner periphery of the case 8. Therefore, as can be appreciated from FIGS. 10A and 10B, the pair of positioning ribs 81 and the supporting rib 82 are formed to extend from a position spaced inwardly by a predetermined distance from the inner end of the cap fitting portion 85 of the case 8 to permit the entry of the cap 80 into the case. The engagement protuberances 84 of the case 8 are adapted to engage with the rear face of the flange 801 of the cap 80 as fitted in the case 8 to hold the cap 80 against withdrawal. Further, the wall 82 of the closed end of the cap has slits 83 formed therethrough into which the terminal portions 52A, 52B and 501 of the contact pieces 5A, 5B and 5C mounted to the substrate 9 are fitted, respectively.

How to attach the shaft securing member 505 to the common contact piece 5C will now be described with reference to FIG. 13. As shown in FIGS. 13B and 13C, the shaft securing member 505 is a generally channel-shaped (U-shaped) member formed by folding a predetermined length of strip-like sheet metal at the opposed end portions thereof in the same direction substantially at right angles, and has tongues 506 formed integrally with and depending downwardly from the central portion 505C at its opposed lateral side edges. Legs 505A and 505B upstanding from the opposed longitudinal ends of the central portion 505C have through holes 507 into which the riveted portions 231 of the rotary shaft 23 shown in FIG. 12 are to be inserted, respectively, formed therethrough at positions of the same elevation in the vicinity of their forward ends.

Figure 13E:
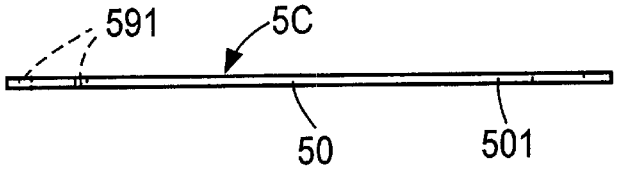
FIG. 13E is a side view of FIG. 13D viewed from below.
Figure 13F:
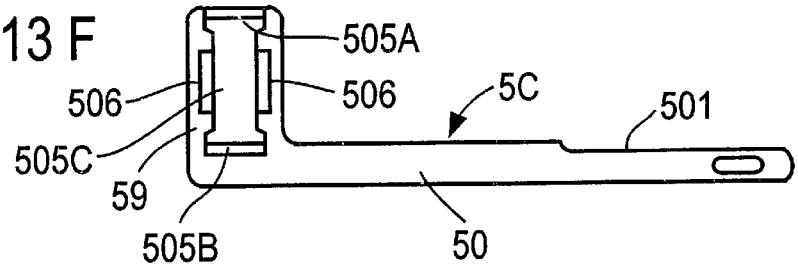
FIG. 13F is a plan view illustrating a manner in which the shaft securing member shown in FIG. 13A is mounted to the common contact piece shown in FIG. 13D.
Figure 13G:
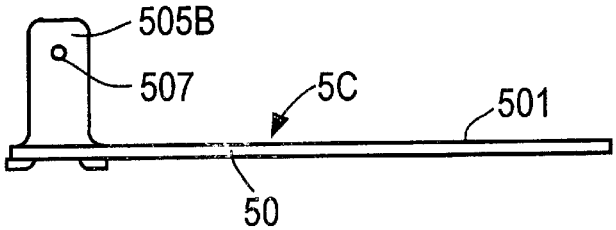
FIG. 13G is a side view of FIG. 13F as viewed from below.

As shown in FIGS. 13D and 13E, the contact portion 59 of the common contact piece 5C has two parallel slits 591 formed therethrough along the opposed side edges of the contact portion 59. The tongues 506 of the shaft securing member 505 are inserted through the corresponding slits 591 and the forward end portions of the tongues 506 protruding beyond the back surface of the central portion 505C of the shaft securing member 505 are bent outwardly oppositely from each other, whereby the shaft securing member 505 is attached to the contact portion 59 of the common contact piece 5C as shown in FIGS. 13F and 13G.

The magnetic sensor 2 is mounted for rotation in the clockwise and counter-clockwise directions by inserting the rotary shaft 23 shown in FIG. 12 into the bearing aperture 212 of the magnetic sensor 2 and then inserting rings 7 into the rotary shaft 23 at the opposed sides of the magnetic sensor 2, followed by passing the riveted portions 231 of the rotary shaft 23 through the through holes 507 of the legs 505A and 505B of the shaft securing member 505 and striking and riveting the riveted portions 231 to the legs 505A and 505B.

Figure 14A:
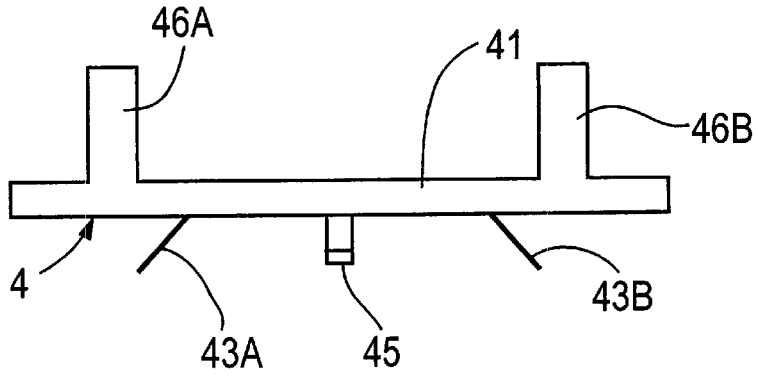
FIG. 14A is a side view of the movable contact piece.
Figure 14B:
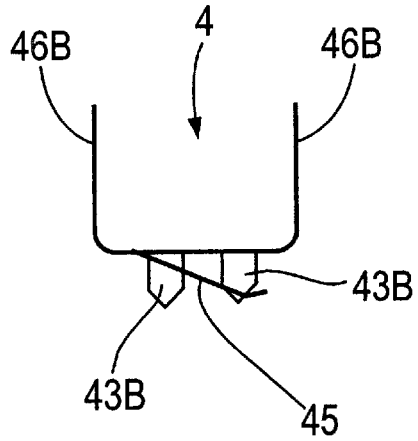
FIG. 14B is a right-hand side view of FIG. 14A.
Figure 14C:
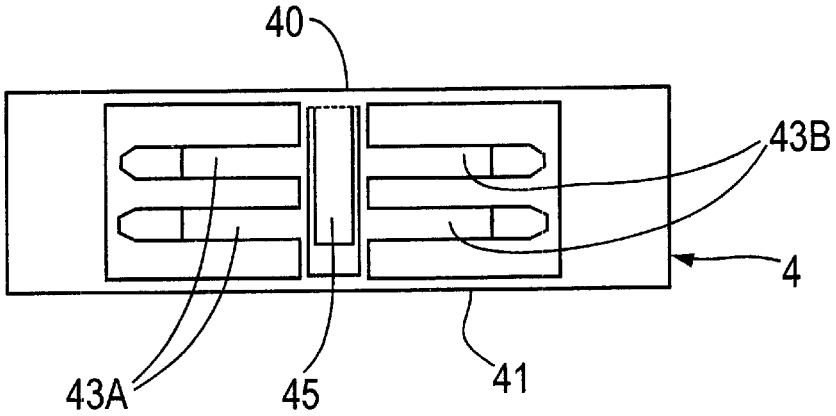
FIG. 14C is a top view of FIG. 14A.

As shown in FIG. 14, the movable contact piece 4 comprises an electrically conductive plate-like member 41 of a rectangular shape in a plan view, an elongated tongue 45 formed in the central portion 40 of the plate-like member 41 in the width direction thereof, first two elongated tongues 43A and second two elongated tongues 43B formed in the regions adjoining the central portion 40 of the plate-like member 41 on the opposite sides thereof and extending in opposite directions longitudinally of the plate-like member 41, and two pairs of the attaching strips or bands 46A and 46B, one pair thereof extending upwardly from each of the opposite side edges near one of the opposed longitudinal ends of the plate-like member 41, and the other pair extending upwardly from each of the opposite side edges near the other longitudinal end of the plate-like member 41.

In this embodiment, the first and second elongated tongues 43A and 43B have their end portions toward the longitudinal ends of the plate-like member 41 bent downwardly such that the first two elongated tongues 43A function as first contact blades in contact with the upper surface of the contact portion 51A of the first fixed contact piece 5A while the second two elongated tongues 43B function as second contact blades in contact with the upper surface of the contact portion 51B of the second fixed contact piece 5B. Thus, the tongues 43A and 43B are called contact blades in this specification.

The elongated tongue 45 formed in the central portion 40 of the plate-like member 41 by being folded therefrom has its forward end bent upwardly as shown in FIG. 7, and when the magnetic sensor 2 is mounted to the shaft securing member 505, the elongated tongue 45 of the movable contact piece 4 is adapted to contact with the surface of the central portion 505C of the shaft securing member 505 so that the tongue 45 functions to electrically connect the movable contact piece 4 with the contact portion 59 of the common contact piece 5C by way of this central portion 505C of the shaft securing member 505. The movable contact piece 4 may be manufactured by working processing an electrically conductive sheet metal, for example.

Next, the steps of mounting the component elements (members) described above on the substrate 9, and then housing the substrate 9 in the case 8 to assemble the magnetic sensor switch of this embodiment will be explained.

First, the first and second fixed contact pieces 5A and 5B and the common contact piece 5C are fitted and secured in the respective grooves in the substrate 9. As a result, the contact portion 59 of the common contact piece 5C is disposed in the space between the contact portion of the first fixed contact piece 5A and the contact portion of the second fixed contact piece 5B in the central portion of the substrate 9 in the manner that they are electrically insulated from one another. Prior to securing these contact pieces 5A, 5B and 5C in place, the shaft securing member 505 has been in advance assembled in the common contact piece 50 as described hereinabove and the movable contact piece 4 has been in advance attached to the flat region on the underside of the magnetic sensor 2 by wrapping, tightening and fixing the attaching strips 46A and 46B around the outer periphery of the magnetic sensor 2.

Then, the riveted portions 231 of the rotary shaft 23 over which the magnetic sensor 2 and the rings 7 have been inserted are passed through the through holes 507 of the legs 505A and 505B of the shaft securing member 505 and riveted thereto. As stated above, the magnetic sensor 2 has been in advance inserted by way of its bearing aperture 212 over the rotary shaft 23 and the rings 7 have been inserted over the rotary shaft on the opposite sides of the sensor. Once the magnetic sensor 2 has been rotatably mounted on the shaft securing member 505 in such manner, the movable contact piece 4 attached to the underside of the magnetic sensor 2 is positioned such that the first contact blades 43A of the movable contact piece 4 are opposed to the portion 51A of the first fixed contact piece 5A and the second contact blades 43B of the movable contact piece 4 are opposed to the contact portion 51B of the second fixed contact piece 5B. In addition, as the elongated tongue 45 of the movable contact piece 4 is brought into contact with the surface of the central portion 505C of the shaft securing member 505, the movable contact piece 4 is electrically connected with the contact portion 59 of the common contact piece 5C by way of the central portion 505C of the shaft securing member 505.

The substrate 9 having the component elements assembled thereon as stated above is then inserted and housed in the elongated generally cylindrical case 8. First, with the forward end of the substrate 9 placed on the upper surface of the supporting rib 82 of the case 8 and with the opposite corners of the forward end of the substrate 9 in contact with the steps of the positioning ribs 81 of the case 8, the substrate 9 is pushed into the case 8 through the side of the cap fitting portion 85. Then, the terminal portions 52A, 52B and 501 of the contact pieces 5A, 5B and 5C protruding from the substrate 9 are fitted in the respective slits 83 of the cap 80 and the cap 80 is forcedly fitted into the cap fitting portion 85 of the case 8. The cap 80 is ultimately secured in the cap fitting portion 85 by that the flange 801 formed around the outer periphery of the closed end of the cap 80 climbs over the engagement protuberances 84. Thus, the assembly of the magnetic sensor switch is completed.

Next, the operation of the magnetic sensor switch constructed as described above will be explained.

In this embodiment, as noted above, the polarity of the auxiliary magnet 6 is such that the upper end face thereof in the drawing is S pole while the lower end face thereof is N pole. That is, the magnetic sensor 2 is polarized such that its one end 22A is N pole while the other end thereof is S pole. Accordingly, an attractive force is generated between the N pole of the one end 22A of the magnetic sensor 2 and the S pole of the auxiliary magnet 6, whereby as a result of the one end 22A being strongly attracted toward the auxiliary magnet 6, the magnetic sensor 2 is rotated in the counter-clockwise direction from the horizontal position shown in FIG. 8 about the rotary shaft 23 until the one end 22A of the magnetic sensor 2 comes into abutment with the surface of the substrate 9 or any suitable stopper not shown, whereupon the magnetic sensor 2 ceases its counter-clockwise rotation. Thus, in the standby state, the magnetic sensor 2 is at rest with its left-hand end lowered. In this standby state, the first contact blades 43A of the movable contact piece 4 is in contact with the contact portion 51A of the first fixed contact piece 5A. Consequently, the terminal portion 51A of the first fixed contact piece 5A is electrically connected with the terminal portion 501 of the common contact piece 50 through the first contact blades 43A and the elongated tongue 45 of the movable contact piece 4, the central portion 505C of the shaft securing member 505, and the contact portion 59 of the common contact piece 5C.

In the standby state described above, when the S pole of an external magnet approaches the magnetic sensor switch from the upper side thereof in the drawing, the N pole of the one end 22A of the magnetic sensor 2 is subjected to a force in the sense to be attracted toward the S pole of the external magnet while the S pole of the other end 22B is subjected to a force in the sense to be repelled by the S pole of the external magnet. As a result, a clockwise rotating force is applied to the magnetic sensor 2.

As the S pole of the external magnet further approaches the magnetic sensor switch and the instant that the attractive and repulsive forces caused by the S pole of the external magnet exceed the attractive force between the auxiliary magnet 6 and the N pole of the one end 22A of the magnetic sensor 2, the magnetic sensor 2 is rotated in the clockwise direction until the other end 22B comes into abutment with the surface of the substrate 9 or any suitable stopper not shown, whereupon the magnetic sensor 2 ceases its clockwise rotation. That is, when the S pole of the external magnet approaches to a position spaced a predetermined distance from the magnetic sensor switch, the magnetic sensor 2 becomes stationary in the tilted position with the other end 22B lowered. In this case, the attractive force between the auxiliary magnet 6 and the one end 22A of the magnetic sensor 2 is in opposition to the clockwise rotating force produced by the approach of the S pole of the external magnet and applied to the magnetic sensor 2. In addition, due to the first contact blades 43A itself of the movable contact piece 4 having resiliency, the magnetic sensor 2 is also afforded a clicking action by the first contact blades 43A on rotating in the reverse direction, whereby the reversing action of the magnetic sensor 2 may be accelerated.

As the magnetic sensor 2 is rotated in the clockwise direction, the movable contact piece 4 is likewise rotated in the counter-clockwise direction, so that upon the S pole of the external magnet approaching to the predetermined distance, the second contact blades 43B of the movable contact piece 4 come into contact with the contact portion 51B of the second fixed contact piece 5B. Consequently, at this time the terminal portion 51B of the second fixed contact piece 5B is electrically connected with the terminal portion 501 of the common contact piece 50 through the second contact blades 43B and the elongated tongue 45 of the movable contact piece 4, the central portion 505C of the shaft securing member 505, and the contact portion 59 of the common contact piece 5C.

As the S pole of the external magnet moves away from the magnetic sensor switch and the instant that the attractive and repulsive forces caused by the S pole of the external magnet becomes smaller than the attractive force between the auxiliary magnet 6 and the one end 22A of the magnetic sensor 2, magnetic sensor 2 is rotated in the counter-clockwise direction until the one end 22A comes into abutment with the surface of the substrate 9 or any suitable stopper not shown, whereupon the magnetic sensor 2 comes to a standstill. That is, when the S pole of the external magnet moves away from the magnetic sensor switch beyond the predetermined distance, the magnetic sensor 2 becomes again stationary in the tilted position with the one end 22A lowered. In this case, due to the second contact blades 43B itself of the movable contact piece 4 having resiliency, the reversing action of the magnetic sensor 2 may be accelerated.

Alternatively, it is possible to adopt such arrangement that the magnetic sensor 2 is held at a standby position that is a position rotated through predetermined degrees from the horizontal position by the utilization of the repulsive force caused by the auxiliary magnet 6. For example, the auxiliary magnet 6 may be fitted in the groove 113 with its S magnetic pole and N magnetic pole reversed. With this arrangement, a repulsive force is generated between the N pole of the one end 22A of the magnetic sensor 2 and the N pole of the auxiliary magnet 6 so that the one end 22A of the magnetic sensor 2 is strongly repelled by the auxiliary magnet 6. As a result, the magnetic sensor 2 is rotated in the clockwise direction from the horizontal position shown in FIG. 8 about the rotary shaft 23 until the other end 22B of the magnetic sensor 2 comes into abutment with the surface of the substrate 9 or any suitable stopper not shown, whereupon the magnetic sensor 2 ceases its clockwise rotation. Accordingly, in this case, the magnetic sensor 2 is at rest with its right-hand end lowered in the standby state.

In the standby state described just above, when the N pole of an external magnet approaches the magnetic sensor switch from the upper side thereof in the drawing, the S pole of the other end 22B of the magnetic sensor 2 is subjected to a force in the sense to be attracted toward the N pole of the external magnet while the N pole of the one end 22A is subjected to a force in the sense to be repelled by the N pole of the external magnet. As a result, a counter-clockwise rotating force is applied to the magnetic sensor 2.

As the N pole of the external magnet further approaches the magnetic sensor switch and the instant that the attractive and repulsive forces caused by the N pole of the external magnet exceed the repulsive force between the auxiliary magnet 6 and the N pole of the one end 22A of the magnetic sensor 2, the magnetic sensor 2 is rotated in the counter-clockwise direction until the one end 22A comes into abutment with the surface of the substrate 9 or any suitable stopper not shown, whereupon the magnetic sensor 2 ceases its counter-clockwise rotation. That is, when the N pole of the external magnet approaches to a position spaced a predetermined distance from the magnetic sensor switch, the magnetic sensor 2 becomes stationary in the tilted position with the one end 22A lowered. In this case, due to the second contact blades 43B itself of the movable contact piece 4 having elasticity, the magnetic sensor 2 is afforded a clicking action on rotating in the reverse direction, whereby the reversing action of the magnetic sensor 2 may be accelerated.

As the N pole of the external magnet moves away from the magnetic sensor switch and the instant that the attractive and repulsive forces caused by the N pole of the external magnet becomes smaller than the repulsive force between the auxiliary magnet 6 and the one end 22A of the magnetic sensor 2, the magnetic sensor 2 is rotated in the clockwise direction until the other end 22B of the magnetic sensor 2 again comes into abutment with the surface of the substrate 9 or any suitable stopper not shown, whereupon the magnetic sensor 2 comes to a standstill. That is, when the N pole of the external magnet moves away from the magnetic sensor switch beyond the predetermined distance, the magnetic sensor 2 becomes again stationary in the tilted position with the other end 22B lowered. In this case, the repulsive force between the auxiliary magnet 6 and the one end 22A of the magnetic sensor 2 is in opposition to the counter-clockwise rotating force produced by the approach of the N pole of the external magnet and applied to the magnetic sensor 2. In addition, due to the first contact blades 43A itself of the movable contact piece 4 having elasticity, the reversing action of the magnetic sensor 2 when it is again rotated in the clockwise direction may be accelerated.

The standby state position of the magnetic sensor 2 and the stop position of the magnetic sensor 2 after it has rotated in the reverse direction may be regulated or controlled by adjusting the height of the stoppers. Therefore, the detection distance for an external magnet may be regulated or controlled by adjusting the height of the stoppers. Consequently, the detection distance for an external magnet of this magnetic sensor switch may be finely regulated or controlled by adjustment of the height of the stoppers as well as the intensity of the magnetic field of the auxiliary magnet 6.

In the first embodiment described above, while the auxiliary magnet 6 is used in order to hold the magnetic sensor 2 in its standby state and to add a clicking action to the magnetic sensor 2 when it rotates in the reverse direction, it is to be appreciated that a member of magnetic material may be utilized with equal functions and results in place of the magnet, since the auxiliary magnet 6 is mainly intended to give a biasing force that acts to rotate the magnetic sensor 2 to its standby state position and holding it in that position. Or alternatively, a coil spring or any other resilient member may be engaged with the magnetic sensor 2 to give a predetermined elastic biasing force to the magnetic sensor 2 in order to rotate the magnetic sensor 2 to its standby state position and hold it in that position.

Further, while an elongated generally cylindrical rod-like magnet having N pole at one end and S pole at the other end is used as the magnetic sensor 2, similar functions and results may be obtained if an elongated rod-like member comprising a central body of magnetic material and magnets attached to the opposite ends of the central body is used as the magnetic sensor 2.

Next, a second embodiment of the magnetic sensor switch according to the present invention will be described in detail with reference to FIGS. 15 to 19. It is to be noted that in FIGS. 15 to 19, parts and elements (members) corresponding to those in FIGS. 4 to 14 are denoted by the same reference characters attached thereto and the explanation thereof will be omitted unless required.

Figure 16:
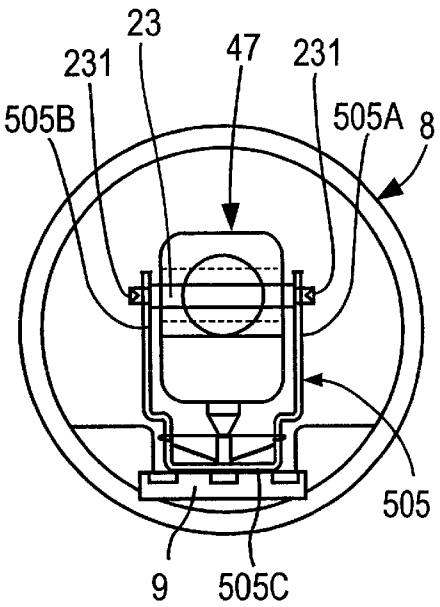
FIG. 16 is a side view of the case shown in FIG. 15 taken along a vertical line in FIG. 15.
Figure 15:
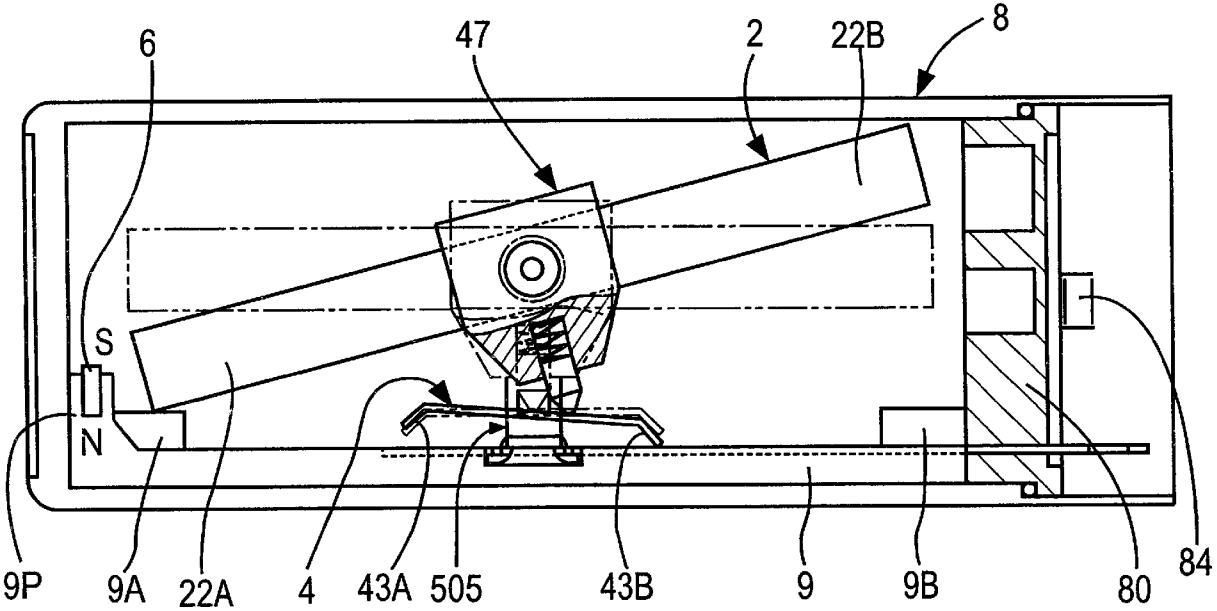
FIG. 15 a front view showing a second embodiment of the magnetic sensor switch according to the present invention.

As shown in FIGS. 15 and 16, the magnetic sensor switch of the second embodiment comprises: a magnetic sensor switch 2 constituted by an elongated generally cylindrical rod-like magnet having one magnetic pole at one end 22A thereof and the other magnetic pole at the other end 22B thereof; a movable contact piece 4 having a pair of opposed contact blades 43A and 43B; a pair of fixed contact pieces disposed in opposition to the pair of contact blades 43A and 43B of the movable contact piece 4; a common contact piece electrically connected with the movable contact piece 4; and a driving member 47 made of an electrically insulating material which is fixed to the central portion of the magnetic sensor 2 and is adapted to rotate in union with the magnetic sensor 2 to transmit the movement of the magnetic sensor 2 to the movable contact piece 4.

As in the first embodiment, since the pair of fixed contact pieces and the common contact piece are mounted on the substrate 9 as shown in FIG. 4, those elements will not be further described.

Figure 17A:
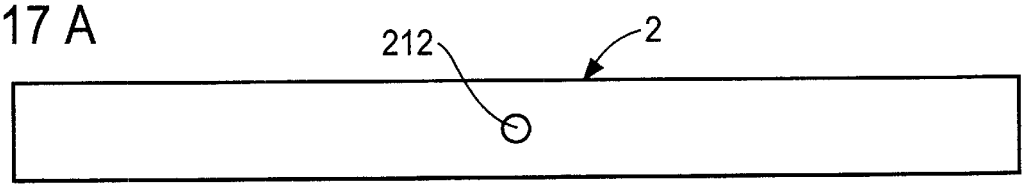
FIG. 17A is a side view showing the magnetic sensor.

In this second embodiment as well, the magnetic sensor 2 is polarized such that its one end 22A is N pole while the other end is S pole, and is mounted for rotation in clockwise and counter-clockwise directions about the rotary shaft 23 that has been fixed to the shaft securing member 505. The sensor 2 has a bearing aperture 212 in the center thereof into which the rotary shaft 23 is inserted, the bearing aperture 212 being formed through the center of the magnetic sensor 2 in the direction orthogonal to the longitudinal direction of the magnetic sensor 2, as shown in FIG. 17A.

Figure 17B:
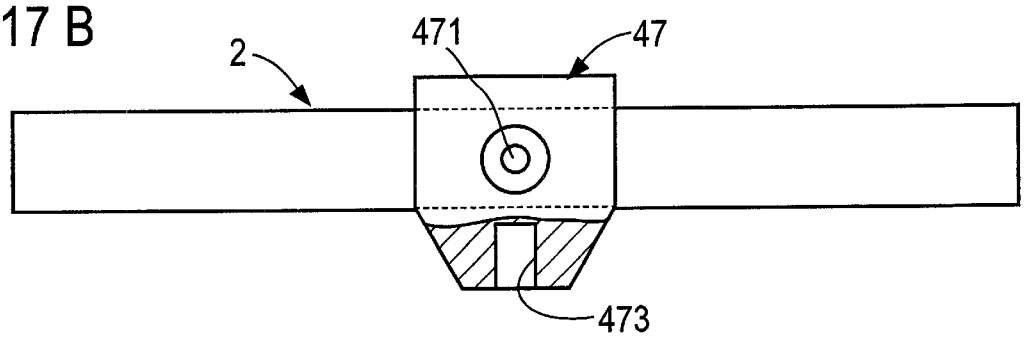
FIG. 17B is a side view illustrating a manner in which the magnetic sensor and the driving member are assembled.
Figure 17C:
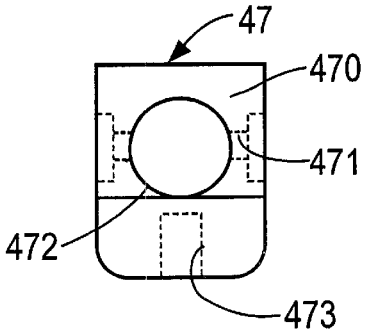
FIG. 17C is a front view showing the shaft securing member.
Figure 17D:
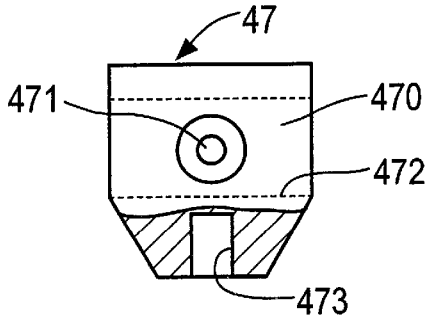
FIG. 17D is a right-hand side view of FIG. 17C.
Figure 17E:
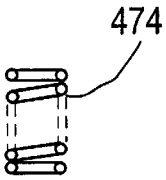
FIG. 17E is a plan view showing the coil spring.

As shown in FIGS. 17C and 17D, the driving member 47 comprises: a driving member body 470 of generally rectangular parallelepipedic shape; a through-bore 472 formed through the body 470 more or less toward the upper portion thereof for passing the magnetic sensor 2 therethrough; a rotary shaft inserting aperture 471 formed through the driving member body 470 so as to have the same center as that of the through-bore 472 and to intersect at right angles with the through-bore 472 in the horizontal plane; and a push-rod inserting hole 473 of a predetermined length extending from the undersurface of the driving member body 470 into the body along the vertical center line thereof.

Figure 17F:
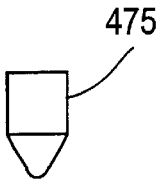
FIG. 17F is a plan view showing the push rod.

As shown in FIG. 17B, the driving member 47 is fixed to the magnetic sensor 2 at the center thereof after the magnetic sensor 2 has been inserted through the through-bore 472. In doing so, the rotary shaft inserting aperture 471 of the driving member 47 and the bearing aperture 212 of the magnetic sensor 2 are accurately aligned with each other prior to the fixing. In the push-rod inserting hole 473 of the driving member 47, a coil spring 474 shown in FIG. 17E and a push-rod 475 shown in FIG. 17F are successively inserted during the assembly of the magnetic sensor switch.

The shaft securing member 505 is a generally channel-shaped (U-shaped) member formed by folding a predetermined length of strip-like sheet metal at the opposite end portions of the central portion thereof in the same direction substantially at right angles, and has tongues 506 formed integrally with and depending downwardly from the central portion 505C at its opposite lateral side edges. The parallel legs 505A and 505B upstanding from the opposite longitudinal ends of the central portion 505C expand outwardly away from each other at their bends formed between the intermediate portions and the lower ends prior to extending straight upwardly in parallel with each other. The two legs 505A and 505B have through holes 507, respectively, into which the riveted portions 231 of the rotary shaft 23 are to be inserted, the through holes 507 being formed through the legs 505A and 505B at positions of the same elevation adjacent to their forward ends.

The two legs 505A and 505B further have square shape through holes 508, respectively, formed therethrough at positions of the same elevation just below the bends of the legs for rotatably supporting a movable contact piece shown in FIG. 19. These through holes 508 have their lower side edges formed in the shape of a low mountain, respectively, on the apexes of which the movable contact piece 4 are supported so as to facilitate the rotational movement of the movable contact piece 4. In addition, the lower side edges of the through holes 508 make the electrical contact between the movable contact piece 4 and the shaft securing member 505 enhanced, so that the movable contact piece 4 is satisfactorily electrically connected with the common contact piece through the shaft securing member 505.

Figure 19A:
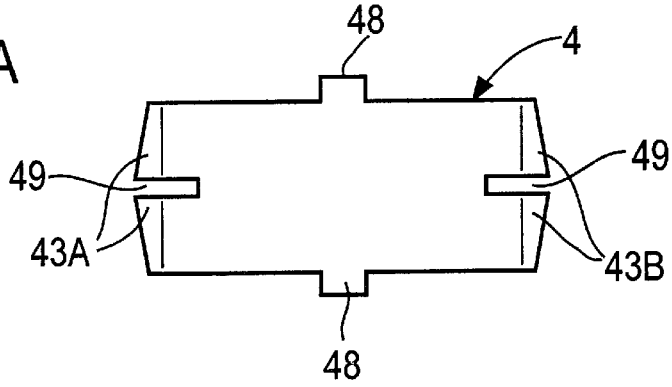
FIG. 19A is a plan view of the contact piece.
Figure 19B:
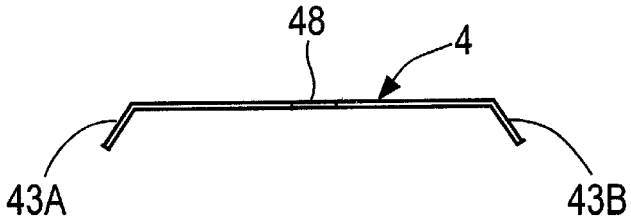
FIG. 19B is a side view as viewed from below.

As shown in FIGS. 19A and 19B, the movable contact piece 4 is a plate-like electrical conductor of a rectangular shape in plan view, and has a pair of support tabs 48 formed integrally therewith and outwardly protruding therefrom at the same position in the middle portions of the opposite longitudinal side edges. The pair of support tabs 48 are inserted and engaged in the square shape through holes 508 formed through the two legs 505A and 505B of the shaft securing member 505, and function to rotatably support the movable contact piece 4. In addition, the movable contact piece 4 has a pair of slits 49 formed in the opposite longitudinal end portions thereof so as to extend for a predetermined distance along the longitudinal center line inwardly from the opposite end faces, and the opposite longitudinal end portions of the movable contact piece 4 are divided into two portions by the slits 49 to define four tongues in total of two tongues 43A at one end and two tongues 43B at the other end. The opposite longitudinal end portions of the movable contact piece 4 are formed in the shape of a mountain having an apex in the center thereof, which serves to enhance the electrical contact of the movable contact piece 4 with the corresponding contact portion of the fixed contact piece as well as to provide the tongues 43A and 43B with resiliency. As a result, a resilient force is added to the magnetic sensor 2 when it reverses its rotating movement, thereby to facilitate quick reverse rotation of the magnetic sensor 2. As in the first embodiment, these tongues 43A and 43B will be called contact blades hereinafter.

Next, the steps of mounting the component elements (members) described above on the substrate 9, and then housing the substrate 9 in the case 8 to assemble the magnetic sensor switch of this second embodiment will be explained.

Figure 18A:
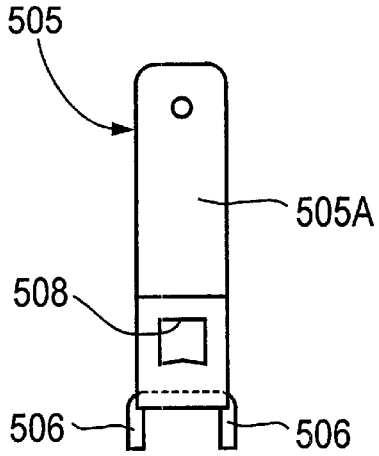
FIG. 18A is a side view of the shaft securing member.
Figure 18B:
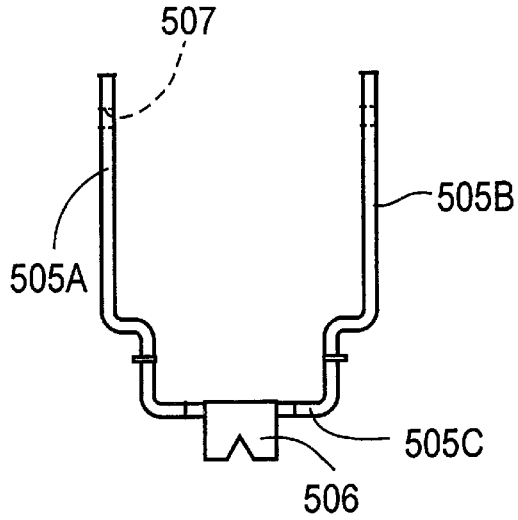
FIG. 18B is a right-hand side view of FIG. 18A.

First, as in the first embodiment, prior to fixing the first and second fixed contact pieces and the common contact piece to the substrate 9 in place, the shaft securing member 505 shown in FIG. 18 has been assembled to the common contact piece and the pair of support tabs 48 of the movable contact piece 4 have been inserted and engaged in the square shape through holes 508 formed in the two legs 505A and 505B of the shaft securing member 505. In addition, the rotary shaft 23 has been also inserted through the bearing aperture 212 of the magnetic sensor 2 and the rotary shaft inserting aperture 471 of the driving member 47.

Then, with the coil spring 474 and the push-rod 475 inserted in the push-rod inserting hole 473 of the driving member 47 in the order named, the riveted portions 231 of the rotary shaft 23 over which the magnetic sensor 2 the driving member 47 are already inserted are inserted through the through holes 507 of the legs 505A and 505B of the shaft securing member 505, and struck and riveted on the legs 505A and 505B.

When the magnetic sensor 2 and the driving member 47 are rotatably mounted on the shaft securing member 505 in the manner as stated above, the push-rod 475 inserted in the push-rod inserting hole 473 of the driving member 47 by way of the coil spring 474 is subjected to a biasing force from the coil spring 474 in such direction that the push-rod 475 juts outwardly. The conical tip end of the push-rod 475 is brought into pressure contact with the surface on the movable contact piece 4 in the vicinity of the central portion thereof by the biasing force. Accordingly, if the tip end of the push-rod 475 is moved even a little off the center of the movable contact piece 4, the movable contact piece 4 is instantaneously rotated by the pushing power of the push-rod 475 until the corresponding contact blades are brought into electrical contact with the contact portion of the corresponding fixed contact piece. Thus, this fixed contact piece is electrically connected with the contact portion of the common contact piece by way of the movable contact piece 4, the two legs 505A and 505B and the central portion 505C of the shaft securing member 505.

The substrate 9 having the component elements already assembled thereon in the manner as described above is then inserted and housed in the elongated generally cylindrical case 8. Then, the cap 80 is forcedly fitted into the cap fitting portion of the case 8. The cap 80 is ultimately secured in the cap fitting portion by that the flange formed around the outer periphery of the closed end of the cap 80 climbs over the engagement protuberances 84. Thus, the assembly of the magnetic sensor switch is completed.

Next, the operation of the magnetic sensor switch of the second embodiment constructed as described above will be explained.

As discussed above, in this second embodiment as well, the polarity of the auxiliary magnet 6 is such that the upper end face thereof in the drawing is S pole while the lower end face thereof is N pole. The magnetic sensor 2 is polarized such that its one end 22A is N pole while the other end is S pole. As a result, an attractive force is generated between the N pole of the one end 22A of the magnetic sensor 2 and the S pole of the auxiliary magnet 6, and the one end 22A of the magnetic sensor 2 is strongly attracted toward the auxiliary magnet 6 so that the magnetic sensor 2 is rotated in the counter-clockwise direction from the horizontal position shown by the two-dotted chain lines in FIG. 15 about the rotary shaft 23 until the one end 22A of the magnetic sensor 2 comes into abutment with a stopper 9A provided on the substrate 9, whereupon the magnetic sensor 2 ceases its counter-clockwise rotation. Thus, in the standby state, the magnetic sensor 2 is at rest with its left-hand end lowered as shown in the solid lines. In this standby state, as the tip end of the push-rod 475 is pressing on the surface of the movable contact piece 4 on the right side of the center as viewed in the drawing, the second contact blades 43B of the movable contact piece 4 is in contact with the contact portion of the second fixed contact piece. Consequently, the terminal portion of the second fixed contact piece is electrically connected with the terminal portion of the common contact piece through the second contact blades 43B of the movable contact piece 4, the body and support tabs 48 of the movable contact piece 4, the two legs 505A and 505B and the central portion 505C of the shaft securing member 505, and the contact portion of the common contact piece.

In the standby state described above, when the S pole of an external magnet approaches the magnetic sensor switch from the upper side thereof in the drawing, the N pole of the one end 22A of the magnetic sensor 2 is subjected to a force in such direction that it is attracted toward the S pole of the external magnet while the S pole of the other end 22B is subjected to a force in such direction that it is repelled by the S pole of the external magnet. As a result, a clockwise rotating force is applied to the magnetic sensor 2.

As the S pole of the external magnet further approaches the magnetic sensor switch and the instant that the attractive and repulsive forces caused by the S pole of the external magnet exceed the attractive force between the auxiliary magnet 6 and the N pole of the one end 22A of the magnetic sensor 2, the magnetic sensor 2 is rotated in the clockwise direction until the other end 22B comes into abutment with a stopper 9B provided on the substrate 9, whereupon the magnetic sensor 2 ceases its clockwise rotation. That is, when the S pole of the external magnet approaches to a position spaced a predetermined distance from the magnetic sensor switch, the magnetic sensor 2 becomes stationary in the tilted position with the other end 22B lowered. In this case, the attractive force between the auxiliary magnet 6 and the one end 22A of the magnetic sensor 2 is in opposition to the clockwise rotating force produced by the approach of the S pole of the external magnet and applied to the magnetic sensor 2. Further, as the spring 474 urging the push-rod 475 is compressed with the clockwise rotation of the magnetic sensor 2, and the instant that the tip end of the push-rod 475 goes over the center of the movable contact piece 4, the compressive force is applied as a pushing force to the push-rod 475. Because of this, a strong clicking action is provided. In addition, due to the first contact blades 43A itself of the movable contact piece 4 having resiliency, the magnetic sensor 2 is also afforded a clicking action by the first contact blades 43A on reversing its rotating movement, whereby the reversing action of the magnetic sensor 2 may be greatly accelerated.

As the magnetic sensor 2 is rotated in the clockwise direction, the tip end of the push-rod 475 goes over the center of the movable contact piece 4 to the portion of the surface of the movable contact piece on the left-hand side of the center in the drawing, so that the instant the tip end of the push-rod 475 goes over the center of the movable contact piece 4, the movable contact piece 4 is instantaneously rotated in the counter-clockwise direction. Therefore, upon the S pole of the external magnet approaching to the predetermined distance, the first contact blades 43A of the movable contact piece 4 come into contact with the contact portion of the first fixed contact piece. Consequently, at this time the terminal portion of the first fixed contact piece is electrically connected with the terminal portion of the common contact piece through the first contact blades 43A of the movable contact piece 4, the body and support tabs 48 of the movable contact piece 4, the two legs 505A, 505B and the central portion 505C of the shaft securing member 505, and the contact portion of the common contact piece.

As the S pole of the external magnet moves away from the magnetic sensor switch and the instant that the attractive and repulsive forces caused by the S pole of the external magnet becomes smaller than the attractive force between the auxiliary magnet 6 and the one end 22A of the magnetic sensor 2, the magnetic sensor 2 is rotated in the counter-clockwise direction until the one end 22A of the magnetic sensor 2 again comes into abutment with the stopper 9A on the substrate 9, whereupon the magnetic sensor 2 comes to a standstill. That is, when the S pole of the external magnet moves away from the magnetic sensor switch beyond the predetermined distance, the magnetic sensor 2 becomes again stationary in the tilted position with the one end 22A lowered. In this case, due to the second contact blades 43B itself of the movable contact piece 4 having resiliency, the reversing action of the magnetic sensor 2 may be accelerated.

In such case, if the body of the movable contact piece 4 is bent downwardly on the opposite sides of the longitudinal central portion (more or less leftward and rightward of the location of the support tabs 48 in FIG. 19A) to give slants extending downwardly toward the opposite longitudinal ends, it is possible to apply an increased pushing power or force to the movable contact piece 4 because the traveling speed of the push-rod 475 is abruptly accelerated when the tip end of the push-rod 475 passes this bend portion as it moves over the center of the movable contact piece 4 either from the left side surface to the right side surface or from the right side surface to the left side surface in the drawing. Accordingly, since the movable contact piece 4 instantaneously reverses its rotating movement, the switching operation of the contacts thereof are very rapidly made, thereby leading to enhancement of the reliability and performance.

Alternatively, it is possible to adopt such arrangement that the magnetic sensor 2 is held at a standby position that is a position rotated through predetermined degrees from the horizontal position by the utilization of the repulsive force caused by the auxiliary magnet 6. For example, in FIG. 15, the auxiliary magnet 6 may be fitted in the groove 113 with its S magnetic pole and N magnetic pole reversed. With this arrangement, a repulsive force is generated between the N pole of the one end 22A of the magnetic sensor 2 and the N pole of the auxiliary magnet 6 so that the one end 22A of the magnetic sensor 2 is strongly repelled by the auxiliary magnet 6. As a result, the magnetic sensor 2 is rotated in the clockwise direction from the horizontal position shown by two-dotted chain lines in FIG. 15 about the rotary shaft 23 until the other end 22B of the magnetic sensor 2 comes into abutment with the stopper 9B of the substrate 9, whereupon the magnetic sensor 2 ceases its clockwise rotation. Thus, in this case, the magnetic sensor 2 is at rest with its right-hand end lowered in the standby state.

In the standby state described just above, when the N pole of an external magnet approaches the magnetic sensor switch from the upper side in the drawing, the S pole of the other end 22B of the magnetic sensor 2 is subjected to a force in such direction that it is attracted toward the N pole of the external magnet while the N pole of the one end 22A is subjected to a force in such direction that it is repelled by the N pole of the external magnet. As a result, a counter-clockwise rotating force is applied to the magnetic sensor 2.

As the N pole of the external magnet further approaches the magnetic sensor switch and the instant that the attractive and repulsive forces caused by the N pole of the external magnet exceed the repulsive force between the auxiliary magnet 6 and the N pole of the one end 22A of the magnetic sensor 2, the magnetic sensor 2 is rotated in the counter-clockwise direction until the one end 22A comes into abutment with the stopper 9A, whereupon the magnetic sensor 2 ceases its counter-clockwise rotation. That is, when the N pole of the external magnet approaches to a position spaced a predetermined distance from the magnetic sensor switch, the magnetic sensor 2 becomes stationary in the tilted position with the one end 22A lowered as shown by the solid lines in FIG. 15. In this case, due to the second contact blades 43B itself of the movable contact piece 4 having elasticity, the magnetic sensor 2 is afforded a clicking action on reversing its rotating movement, whereby the reversing action of the magnetic sensor 2 may be accelerated.

As the N pole of the external magnet moves away from the magnetic sensor switch and the instant that the attractive and repulsive forces caused by the N pole of the external magnet becomes smaller than the repulsive force between the auxiliary magnet 6 and the one end 22A of the magnetic sensor 2, the magnetic sensor 2 is rotated in the clockwise direction until the other end 22B of the magnetic sensor 2 again comes into abutment with the stopper 9B, whereupon the magnetic sensor 2 comes to a standstill. That is, when the N pole of the external magnet moves away from the magnetic sensor switch beyond the predetermined distance, the magnetic sensor 2 becomes again stationary in the tilted position with the other end 22B lowered. In this case, the repulsive force between the auxiliary magnet 6 and the one end 22A of the magnetic sensor 2 is in opposition to the counter-clockwise rotating force produced by the approach of the N pole of the external magnet and applied to the magnetic sensor 2. In addition, due to the first contact blades 43A itself of the movable contact piece 4 having elasticity, the reversing action of the magnetic sensor 2 when it is again rotated in the clockwise direction may be accelerated.

The standby state position of the magnetic sensor 2 and the stop position of the magnetic sensor 2 after it has rotated in the reverse direction may be regulated or controlled by adjusting the height of the stoppers 9A and 9B. Therefore, the detection distance for an external magnet may be regulated or controlled by adjusting the height of the stoppers 9A and 9B. Consequently, the detection distance for an external magnet of this magnetic sensor switch may be finely regulated or controlled by adjustment of the height of the stoppers 9A and 9B as well as the intensity of the magnetic field of the auxiliary magnet 6.

In this second embodiment as well, since the magnetic sensor 2 acts, in response to that the S pole or N pole of the external magnet approaches and leaves the magnetic sensor switch, to instantaneously rotate in the clockwise or counter-clockwise direction, the contact blades 43A and 43B of the movable contact piece 4 that are movable in interlocking relation with the magnetic sensor 2 may be quickly and positively switched into contact with the contact portions of the corresponding fixed contact pieces. Particularly, since the push-rod 475 biased by the spring 474 imparts a stronger clicking action than in the first embodiment, there is an advantage that the instantaneous snapping force of the magnetic sensor 2 when it reverses its rotating movement may be greatly enhanced. In addition, since the standby state of the magnetic sensor 2 is maintained if N pole or S pole of an external magnet approaches the magnetic sensor switch, the magnetic sensor 2 acts only when a particular magnetic pole of a magnet approaches it. Accordingly, the magnetic sensor switch exhibits an excellent sensitivity, and hence its reliability can be enhanced. Moreover, this magnetic sensor switch provides the additional advantages of the reduced cost of manufacture and yet the reduced maintenance cost, because it does not utilize a switch in which a magnetic field is applied directly to the contact portions thereof such as a reed switch.

While in this second embodiment as well, the auxiliary magnet 6 is used in order to hold the magnetic sensor 2 in its standby state and to add a clicking action to the magnetic sensor 2 when it reverses its rotating movement, it is to be appreciated that a member of magnetic material may be utilized with equal functions and results in place of the magnet, since the auxiliary magnet 6 is mainly intended to give a biasing force that acts to rotate the magnetic sensor 2 to its standby state position and holding it in that position. Or alternatively, a coil spring or any other resilient member may be engaged with the magnetic sensor 2 to give a predetermined resilient biasing force to the magnetic sensor 2 in order to rotate the magnetic sensor 2 to its standby state position and hold it in that position.

In addition, though an elongated generally cylindrical rod-like magnet having N pole at one end and S pole at the other end is used as the magnetic sensor 2, similar functions and results may be obtained if an elongated rod-like member comprising a central body of magnetic material and magnets attached to the opposite ends of the central body is used as the magnetic sensor 2.

Further, in the embodiments as described above, the constructions, configurations, shapes and dimensions of the magnetic sensor 2, the movable contact piece 4, the first and second contact blades 43A and 43B of the movable contact piece, the first and second fixed contact pieces 5A and 5B, the common contact piece 5C, the shaft securing member 505, the driving member 47, the auxiliary magnet 6, etc. are illustrated as only one example, and hence it is needless to say that those may be modified and/or changed or altered in various manners as required. Moreover, it should be understood that the locations and positions of the auxiliary magnet 6, and the magnetic material member, etc. are not limited to those illustrated in the embodiments. In addition, the polarities of the magnetic sensor 2 and the auxiliary magnet 6 are not limited to those illustrated in the embodiments.

As will be apparent from the foregoing descriptions, according to the present invention, the magnetic sensor switch is configured such that the magnetic sensor acts, in response to that the S pole or N pole of the external magnet approaches and leaves the magnetic sensor switch, to instantaneously rotate in the clockwise or counter-clockwise direction, whereby the contact blades of the movable contact piece may be switched into contact with the corresponding fixed contact pieces. Accordingly, the switching-over of the switch may be quickly and positively effected. Moreover, since a strong clicking action is added due to the provision of the auxiliary magnet or magnetic material, and/or a biased push-rod, the rotating movement of the magnetic sensor switch may be instantaneously started and the switching-over of the switch may be instantaneously carried out. Consequently, the reliability of the switch may be enhanced. In addition, this magnetic sensor switch introduces the additional advantages of the reduced cost of manufacture and on top of that the reduced maintenance cost, because it does not utilize a switch in which a magnetic field is applied directly to the contact portions thereof such as a reed switch. Furthermore, there is a further advantage that an elongated and much miniaturized magnetic sensor switch such as a cap for a pencil may be provided.

While the present invention has been described with regard to the preferred embodiments shown by way of example, it will be apparent to those skilled in the art that various modifications, alterations, changes, and/or minor improvements of the embodiments described above can be made without departing from the spirit and the scope of the present invention. Accordingly, it should be understood that the present invention is not limited to the illustrated embodiments, and is intended to encompass all such modifications, alterations, changes, and/or minor improvements falling within the scope of the invention defined by the appended claims.

What is claimed is:

1. A magnetic sensor switch comprising:

an elongated magnetic sensor that has N magnetic pole at one end thereof and S magnetic pole at the other end thereof and that is mounted for rotation through a predetermined angle in the clockwise and counter-clockwise directions;

a movable contact piece provided with a pair of contacts;

a pair of fixed contact pieces located in opposition to the pair of contacts of said movable contact piece;

a common contact piece electrically connected with the movable contact piece; and a member that is located at a predetermined position in a region outside of the rotating radius of the magnetic sensor and in the vicinity of the one magnetic pole of the magnetic sensor and that imparts a biasing force for holding the magnetic sensor at a position rotated through a predetermined angle.

2. The magnetic sensor switch as set forth in claim 1, wherein said biasing force imparting member is an auxiliary magnet or a magnetic material that is disposed in a region outside of the rotating radius of the magnetic sensor and at a predetermined position on a longitudinal extension line of the magnetic sensor.

3. The magnetic sensor switch as set forth in claim 2, wherein the magnetic sensor is an elongated generally cylindrical rod-like magnet having N magnetic pole at one end thereof and S magnetic pole at the other end thereof.

4. The magnetic sensor switch as set forth in claim 1, wherein the magnetic sensor is an elongated generally cylindrical rod-like magnet having N magnetic pole at one end thereof and S magnetic pole at the other end thereof.

5. The magnetic sensor switch as set forth in claim 4, further including a shaft securing member of a generally channel-shape in section that is fixed to the contact portion of the common contact piece, the magnetic sensor being rotatably journalled by said shaft securing member.

6. The magnetic sensor switch as set forth in claim 4, wherein said biasing force imparting member is an auxiliary magnet that is disposed in a region outside of the rotating radius of the magnetic sensor and at a predetermined position on a longitudinal extension line of the magnetic sensor, the magnetic sensor being adapted to be held at a position rotated through a predetermined angle by an attractive force between said auxiliary magnet and the corresponding magnetic pole of the magnetic sensor.

7. The magnetic sensor switch as set forth in claim 3, wherein said biasing force imparting member is an auxiliary magnet that is disposed in a region outside of the rotating radius of the magnetic sensor and at a predetermined position on a longitudinal extension line of the magnetic sensor, the magnetic sensor being adapted to be held at a position rotated through a predetermined angle by a repulsive force between said auxiliary magnet and the corresponding magnetic pole of the magnetic sensor.

8. The magnetic sensor switch as set forth in claim 4, wherein said movable contact piece is attached to the magnetic sensor and adapted to be rotated in union with the magnetic sensor when the magnetic sensor is rotated to bring one of the contacts of the movable contact piece into contact with the corresponding fixed contact piece.

9. The magnetic sensor switch as set forth in claim 4, further including a driving member that transmits the movement of the magnetic sensor to the movable contact piece, said driving member being attached to the magnetic sensor and adapted to be rotated in union with the magnetic sensor when the magnetic sensor is rotated to transmit the movement of the magnetic sensor to the movable contact piece.

10. The magnetic sensor switch as set forth in claim 9, wherein said driving member is formed therethrough with a push-rod inserting hole in which a spring for imparting a biasing force and a push-rod are inserted in the order named, the tip end of said push-rod being in engagement with the movable contact piece.

11. The magnetic sensor switch as set forth in claim 4, wherein said pair of fixed contact pieces and said common contact piece are each strip-like members that extend in parallel from one end of an elongated generally rectangular substrate to the vicinity of the central portion between the longitudinal opposite ends thereof and that are mounted on said substrate, the contact portion of the common contact piece being arranged generally in a row longitudinally of the substrate in a space between the contact portions of the pair of fixed contact pieces in such state that they are electrically insulated from one another.

12. The magnetic sensor switch as set forth in claim 1, wherein the magnetic sensor is an elongated generally cylindrical member that comprises; a cylindrical central body made of a magnetic material; a first cylindrical magnet affixed to the cylindrical central body at one end thereof; and a second cylindrical magnet affixed to the cylindrical central body at the other end thereof.

13. The magnetic sensor switch as set forth in claim 1, further including a shaft securing member of a generally channel-shape in section that is fixed to the contact portion of the common contact piece, the magnetic sensor being rotatably journalled by said shaft securing member.

14. The magnetic sensor switch as set forth in claim 1, wherein said biasing force imparting member is an auxiliary magnet that is disposed in a region outside of the rotating radius of the magnetic sensor and at a predetermined position on a longitudinal extension line of the magnetic sensor, the magnetic sensor being adapted to be held at a position rotated through a predetermined angle by an attractive force between said auxiliary magnet and the corresponding magnetic pole of the magnetic sensor.

15. The magnetic sensor switch as set forth in claim 1, wherein said biasing force imparting member is an auxiliary magnet that is disposed in a region outside of the rotating radius of the magnetic sensor and at a predetermined position on a longitudinal extension line of the magnetic sensor, the magnetic sensor being adapted to be held at a position rotated through a predetermined angle by a repulsive force between said auxiliary magnet and the corresponding magnetic pole of the magnetic sensor.

16. The magnetic sensor switch as set forth in claim 1, wherein said movable contact piece is attached to the magnetic sensor and adapted to be rotated in union with the magnetic sensor when the magnetic sensor is rotated to bring one of the contacts of the movable contact piece into contact with the corresponding fixed contact piece.

17. The magnetic sensor switch as set forth in claim 1, further including a driving member that transmits the movement of the magnetic sensor to the movable contact piece, said driving member being attached to the magnetic sensor and adapted to be rotated in union with the magnetic sensor when the magnetic sensor is rotated to transmit the movement of the magnetic sensor to the movable contact piece.

18. The magnetic sensor switch as set forth in claim 17, wherein said driving member is formed therethrough with a push-rod inserting hole in which a spring for imparting a biasing force and a push-rod are inserted in the order named, the tip end of said push-rod being in engagement with the movable contact piece.

19. The magnetic sensor switch as set forth in claim 18, wherein said movable contact piece is constituted by a generally rectangular electrically conductive member, and a movable contact piece body of said conductive member is bent downwardly on the opposite sides of the longitudinal central portion of the conductive member to give slants extending downwardly toward the opposite longitudinal ends.

20. The magnetic sensor switch as set forth in claim 1, wherein said pair of fixed contact pieces and said common contact piece are each strip-like members that extend in parallel from one end of an elongated generally rectangular substrate to the vicinity of the central portion between the longitudinal opposite ends thereof and that are mounted on said substrate, the contact portion of the common contact piece being arranged generally in a row longitudinally of the substrate in a space between the contact portions of the pair of fixed contact pieces in such state that they are electrically insulated from one another.

* * * * *